United States Patent [19]

Seidl

[11] 4,445,250

[45] May 1, 1984

[54] PAINT CASE

[75] Inventor: Allen W. Seidl, South St. Paul, Minn.

[73] Assignee: Thomas B. Tate, South St. Paul, Minn. ; a part interest

[21] Appl. No.: 462,409

[22] Filed: Jan. 31, 1983

[51] Int. Cl.[3] ..... B44D 3/12

[52] U.S. Cl. ..... 15/257.06; 220/4 E

[58] Field of Search ..... 220/4 B, 4 E; 15/257.06

[56] References Cited

U.S. PATENT DOCUMENTS

| | | | |
|---|---|---|---|
| 2,759,620 | 8/1956 | Pharris | 15/257.06 |
| 3,346,137 | 10/1967 | Ricci | 220/4 E |
| 3,937,389 | 2/1976 | Wind | 220/4 E X |

*Primary Examiner*—C. Moore

*Attorney, Agent, or Firm*—Thomas B. Tate

[57] ABSTRACT

The invention is a paint case.

1 Claim, 4 Drawing Figures

PAINT CASE

SUMMARY OF THE INVENTION

The invention is a paint case formed by connecting two paint trays by hinge means, said paint case also being provided with a handle to make it portable.

The object of the invention is to provide an easy means for storing and carrying painting accessories, in combination with paint trays which can be separated to hold paint into which a paint roller can be dipped.

DESCRIPTION OF THE INVENTION

Figure 1:
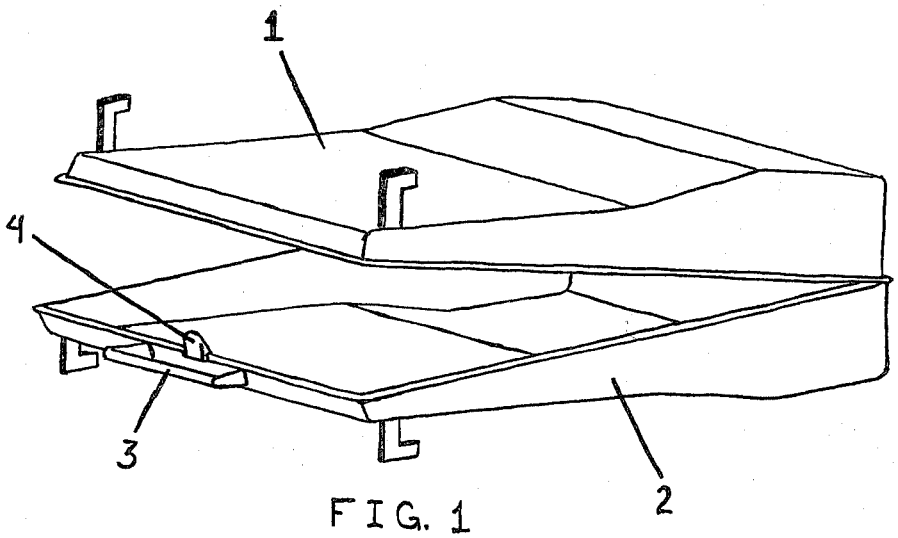
FIG. 1 is a three-quarter perspective view.
Figure 2:
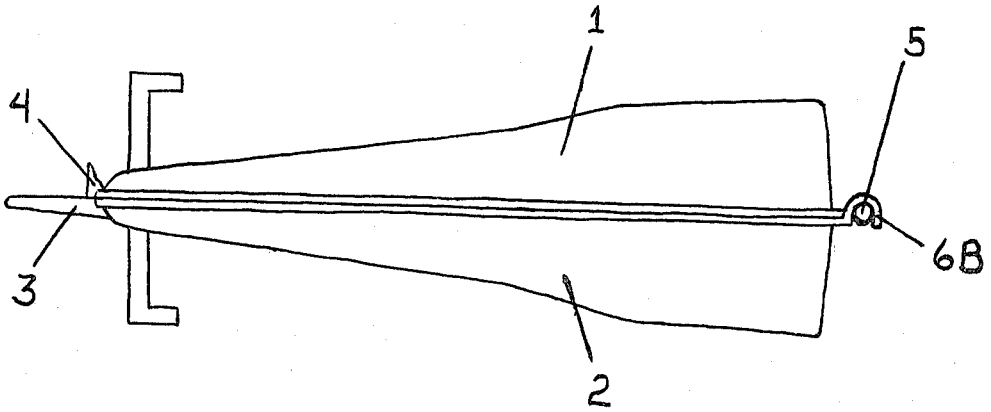
FIG. 2 is a side view.
Figure 3:
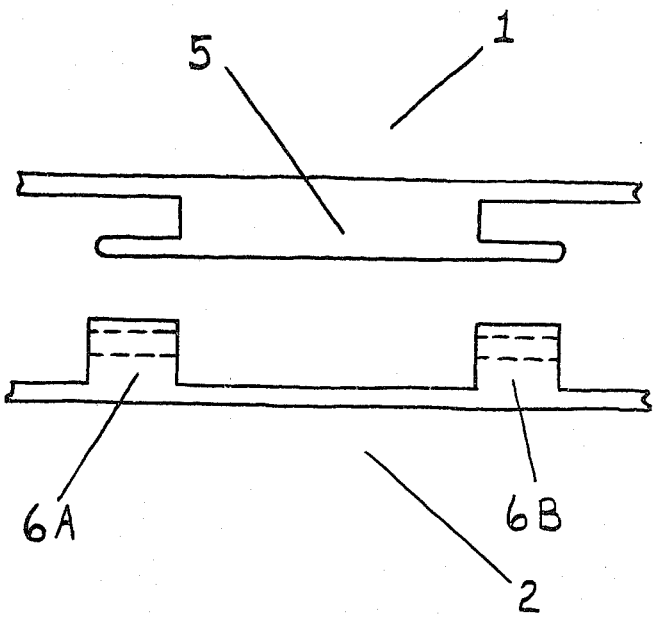
FIG. 3 is a rear view showing detail of the hook mechanism.
Figure 4:
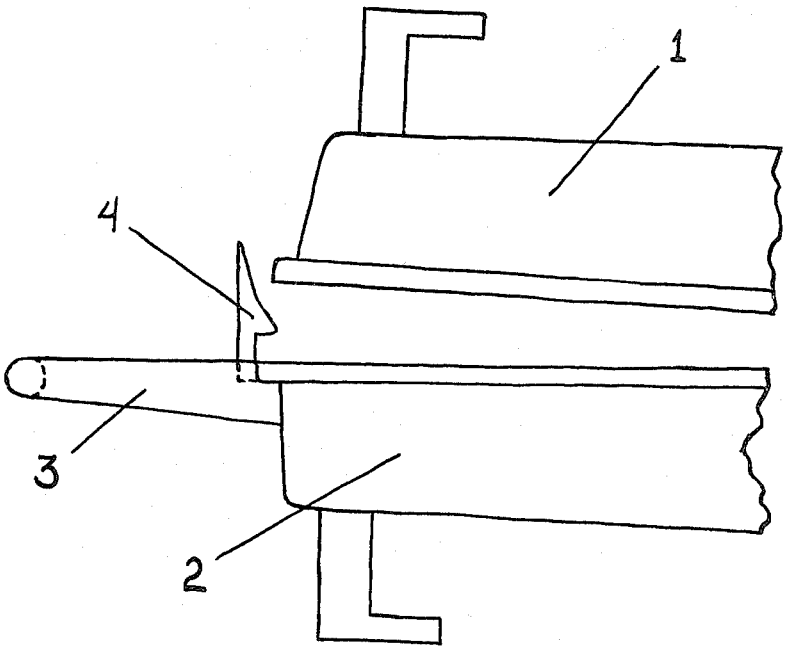
FIG. 4 is a side detail sectional view of the front portion of the paint case.

The invention is a paint case comprising two paint trays (an upper tray 1 and a lower tray 2) which are attached together as shown in FIGS. 1 and 2, and can be separated for use as paint trays.

A handle 3, attached to the front (shallow) end of the lower tray 2, allows the paint case to be carried. A lip catch snap release 4 is attached to the lower tray 2 near the handle 3, and permits the paint case to remain shut securely while being carried.

The upper tray 1 and the lower tray 2 are fastened together as follows: a hinge pin 5 is attached to the back (deep) end of the upper tray 1. The U-shaped pin hooks 6A and 6B fit over the hinge pin 5 when the paint case is closed.

I claim:

1. A paint case comprising:

a first paint tray having a shallow front portion sloping gradually to a deeper back portion, said first paint tray also having a hinge pin mo4nted on its exterior back surface;

and a second paint tray of similar shape and depth as said first tray, aligned vertically and with its interior facing the interior of said first tray, said second tray having hinge pin hook means mounted on its exterior back surface and capable of engaging said hinge pin mounted on said first tray so as to allow said paint case to be closed and opened and said paint trays to be separated;

said second tray also having a handle and lip catch release means mounted on its exterior front surface.

* * * * *